US005144900A

United States Patent [19]

Takahashi

[11] Patent Number: 5,144,900

[45] Date of Patent: Sep. 8, 1992

[54] CONTROL DEVICE FOR SEWING MACHINE

[75] Inventor: Yoshimi Takahashi, Chofu, Japan

[73] Assignee: Juki Corporation, Chofu, Japan

[21] Appl. No.: 468,858

[22] Filed: Jan. 19, 1990

[30] Foreign Application Priority Data

Jan. 20, 1989 [JP] Japan ..... 1-11669

[51] Int. Cl.[5] ..... D05B 19/00

[52] U.S. Cl. ..... 112/121.11; 112/239; 112/275; 112/300; 364/470

[58] Field of Search ..... 112/121.11, 275, 277, 112/239, 237, 235, 300, 285, 220; 364/470

[56] References Cited

U.S. PATENT DOCUMENTS

| | | | |
|---|---|---|---|
| 3,750,603 | 8/1973 | Martin | 112/300 |
| 4,173,193 | 11/1979 | Morinaga et al. | 112/300 X |
| 4,706,588 | 11/1987 | Fujikawa | 112/275 X |
| 4,899,287 | 2/1990 | Hulshoff et al. | 112/121.11 X |

*Primary Examiner*—Peter Nerbun

*Attorney, Agent, or Firm*—Morgan & Finnegan

[57] ABSTRACT

A control device for sewing machines which includes a drive system controller which controls each of numerous driving units provided in the sewing machine and which is connected to an optional command system controller that is positioned outside of the sewing machine. Thus, a control code from the outside command system may be input and decoded to control the drive system controller.

5 Claims, 10 Drawing Sheets

CONTROL DEVICE FOR SEWING MACHINE

FIELD OF INVENTION

This invention relates to a control device for a sewing machine and more particularly to a control device for a sewing machine capable of controlling a drive system for the sewing machine through a controller provided on the side of the drive system.

BACKGROUND OF THE INVENTION

A conventional control device for an industrial sewing machine has been so constructed as to limit its application to the sewing machine in question as shown in FIG. 11. In the drawing, a sewing machine body 1 is provided with a motor 2 which is mounted thereon and to which a controller 4 for the sewing machine is connected by a motor controller 3. The controller 4 is connected to a synchronizer 5 in the body 1 and to system lines for controlling various solenoids. The controller 4 further includes a control panel 6 and a pedal 7 connected thereto.

As seen from FIG. 12, the controller 4 is designed so that a stitch number count control means 9 is connected to the output of a pattern stitch number setting means 8 and a needle position sensing or detecting means 10, respectively. The output of the stitch number count control means 9 is connected to a motor command control means 11 to which the output of a fore-pedaling amount detecting means 12 and a needle stop position setting means 13 are connected, respectively. The output of the motor command control means 11 is connected to a motor drive control means 14. The motor drive control means 14 is connected to the output of the needle position detecting means 10, a motor speed detecting means 15, and a motor angle detecting means 17, respectively. The output of the motor drive control means 14 is connected to a motor drive means 16, while the output of the motor drive means 16 is connected to the motor speed detecting means 15 and the motor angle detecting means 17. The output of an aft-pedalling sensing means 18 is connected to a thread cut mode setting means 19, the output of which is connected to the motor command control means 11 and a thread cut solenoid control means 20. The output of the thread cut solenoid control means 20 is connected to the thread cut mode setting means 19, a thread cut solenoid drive means 21, and a wiper solenoid control means 22 the output of which is connected to a wiper solenoid drive means 23. The output of a presser bar raising switch sensing means 24 is connected to a presser bar raising mode setting means 25 to which the output of the motor command control means 11 is also connected. The output of the presser bar raising mode setting means 25 is connected to a presser bar raising solenoid control means 26 the output of which is connected to a presser bar raising solenoid drive means 27. The output of the wiper solenoid control means 22 is also connected to the presser bar raising solenoid control means 26.

In a conventional control device for sewing machines as constructed above, a number of stitches initially set in control panel 6 is input to the stitch number count means 9 from the pattern stitch number setting means 8. When a fore-pedalling of the pedal 7 is sensed, the signal from the motor command control means 11 is high, and the motor drive control means 14 drives the motor 2 through motor drive means 16. The speed and angle of the motor are sensed by the respective means 15 and 17 and fed back to the motor control means 14 to control the motor 2. A number of stitches defined by the stitch number count control means 9 is subtracted by the signal from the needle position sensing means 10. After a stitch number count reaches 0, the signal from the motor command control means 11 is made low to stop the motor drive means 17 and to stop the needle in a position set by the needle stop position setting means 13.

When an aft-pedalling of the pedal 7 is sensed by the aft-pedalling sensing means 18, the thread solenoid control means 20 and the wiper solenoid control means 22 are activated by the thread cut mode setting means 19 to drive the thread cut solenoid drive means 21 and the wiper solenoid drive means 23. When sewing is completed, the output of the motor command control means 11 is low and a signal for raising a presser bar is input to the presser bar raising mode setting means 25, from the presser bar raising switch sensing means 24, so that the presser bar raising solenoid drive means 27 is driven by the output of the presser bar raising control means 26 to raise the presser bar to a predetermined position.

However, since such a conventional control device for sewing machines is arranged to set (fix) the timing of the thread cut solenoid drive means 21, the wiper solenoid drive means 23, and the presser bar raising solenoid drive means 27 and the like to accommodate the device within the mechanism of the sewing machine body 1, the content of memory means such as ROM and the like stored in the controller 3 must be changed when timings are set to differ from each other in the mechanism of the same sewing machine body 1. Particularly, if a mask ROM is used in the memory means, much time and expense is required for a change in the content thereof.

When a change in timing for each solenoid and the like is required for improvement of the sewing machine body 1 and stitch formation, difficulties are involved since the content of the memory means (ROM and the like) must be also changed.

SUMMARY OF THE INVENTION

The present invention has been proposed to provide a control device for a sewing machine of a type of body which is comprised of a controller of a drive system for directly driving a motor, a solenoid or the like, which is capable of readily changing the sewing machine device to one fit for its purpose, by receiving a command from the outside from a command system controller or the like, to the controller of the drive system.

To achieve the aforementioned object, the present invention is designed so that a sewing machine body which includes a needle position sensing means, a sewing machine motor, a thread cut drive means, and presser bar raising means and the like, is provided with a drive system controller for controlling each of the drive means. The drive system controller is composed of a control code receiving means and a control code deencoding means. When a control code is received from the command system in the control code receiving means, it is decoded and each of the drive means for the sewing machine body is controlled by the drive system controller in response to the input control code.

It is an object of the invention to provide a control device for a sewing machine in which a command system controller, having an control panel, is connected to the control code receiving means in the drive system in order to output the control code to the drive system controller in accordance with the input from the control panel.

It is a further object of the invention to provide a control device for a sewing machine, in which the command drive system controller may be provided with a pedal.

It is another object of the invention to provide a control device for a sewing machine in which a personal computer with a keyboard may be connected to the drive system controller in order to output a control code to the drive system controller in accordance with the input from the keyboard.

In accordance with the present invention, the drive system controller disposed in the sewing machine body includes the control code receiving means adapted to receive the control code, and the control code deencoding means for decoding the control code so that the control code input from the outside is read out to control each of the drive means of the sewing machine according to the control code. Consequently, timing of each of the drive systems of the sewing machine body can be changed as desired according to the control code input. Further, a simple personal computer may be used as a command system controller detachably connected to the drive system controller, instead of the command system controller in the sewing machine, as means to input the control code.

According to the invention constructed as aforementioned, the desired command system controller is freely connected to the drive system for controlling each of the drive means of the sewing machine and can be used as an exclusive or automatic machine. In this connection, it is noted that a change in design may be readily made since no change in the content of the stored memory is required for shifting the drive timing for each of the parts of the sewing machine.

BRIEF DESCRIPTION OF THE DRAWINGS

The invention will be described in greater detail below by way of reference to the following drawings in which.

DESCRIPTION OF THE PREFERRED EMBODIMENT

Figure 1:
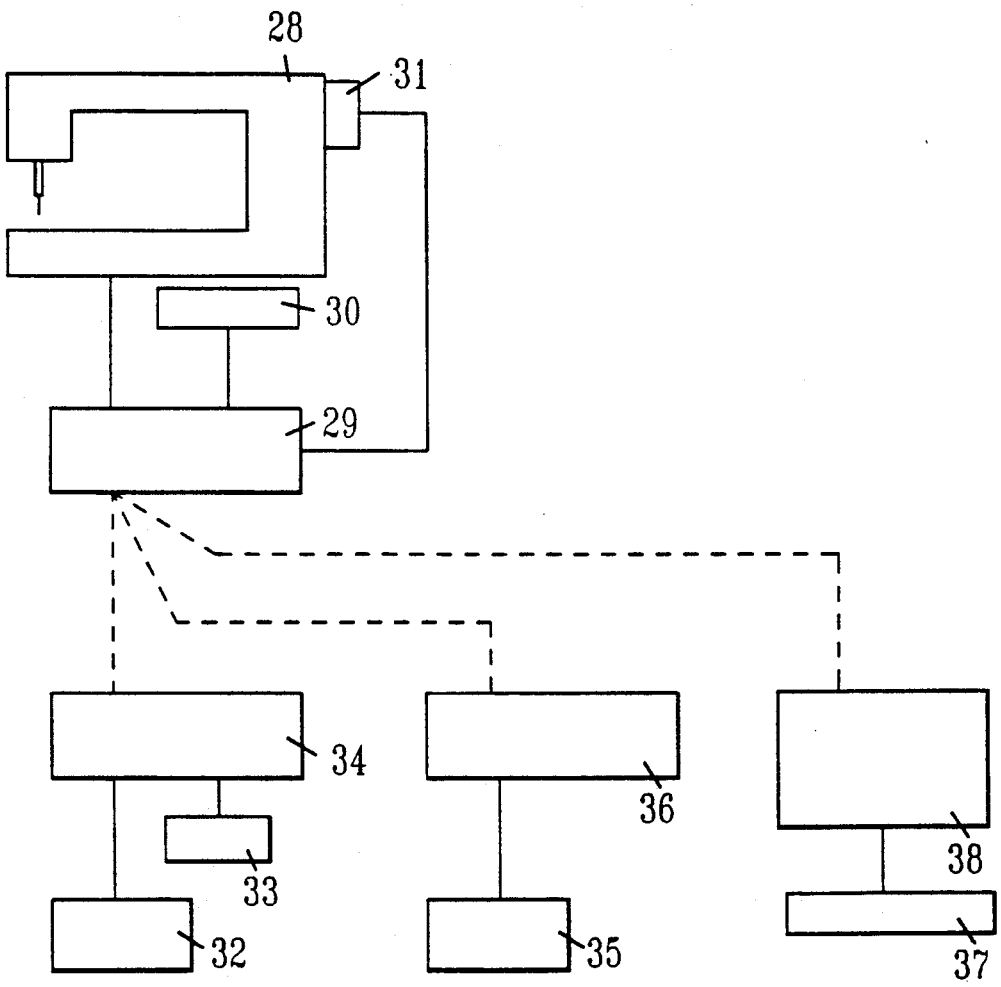
FIG. 1 is a block diagram schematically showing a sewing machine control system embodying the present invention.

Referring to FIG. 1, a control device for a sewing machine embodying the present invention comprises a sewing machine body 28 which is composed of a drive system controller 29, a motor 30, a synchronizer 31 and solenoids such as a thread cut solenoid and the like. The sewing machine body 28, provided with a plurality of drive means, and the drive system controller 29 are constructed as a set.

For inputting a control signal, the drive system controller 29 is connected through an interface to a command system controller 34 having a control panel 32 and a pedal 33, or a command system controller 36 for an automatic sewing machine having only a control panel 35, or a personal computer 38 for the automatic sewing machine providing a keyboard 37.

Figure 2:
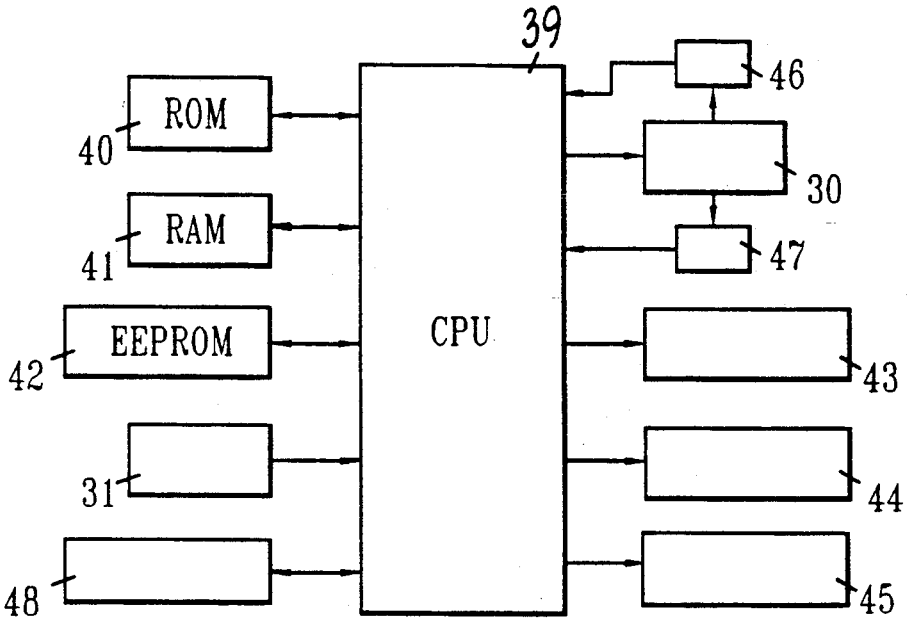
FIG. 2 is a block diagram of a drive system of the control system shown in FIG. 1.

Referring to FIG. 2, a ROM 40, a RAM 41, and an electrically erasable/programmable read-only memory (EEPROM) as memory means are connected to a CPU 39 of the drive system controller 29 embodying the invention. The motor 30, a thread cut solenoid 43, a wiper solenoid 44, and a presser bar raising solenoid 45 are employed as drive means and are also connected to the CPU 39. Further, a motor speed sensing means 46, a motor angle sensing means 47, and a synchronizer or a needle position sensing means 31 are employed as sensing means and are connected to the CPU. Moreover, an interface 48 connected to an outside command drive controller is connected to the CPU 39.

Figure 3:
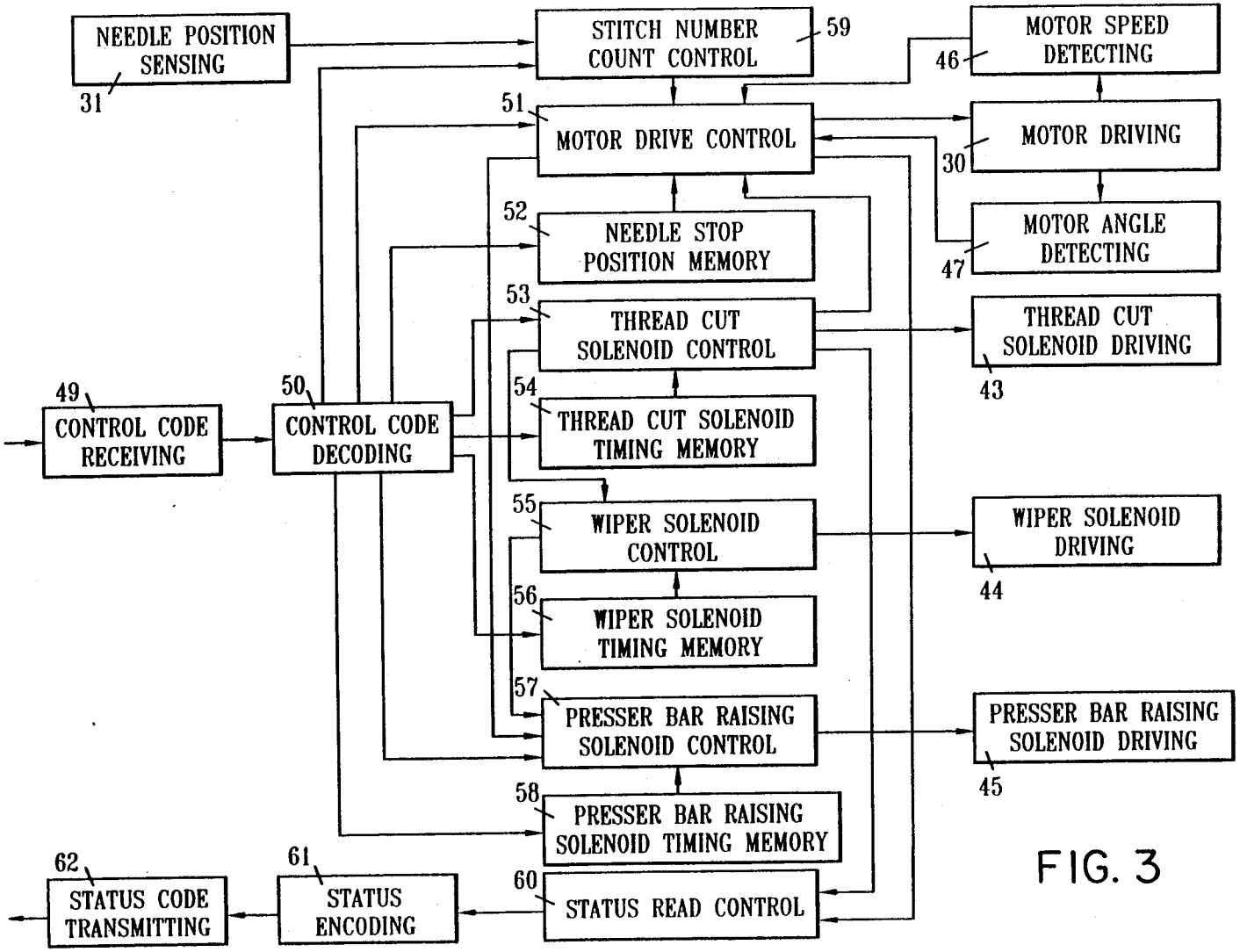
FIG. 3 is a block diagram showing functions of the drive system in FIG. 2.

Referring to FIG. 3, the CPU 39 of the drive system controller 29 is formed with a control code receiving means 49 for receiving a control code input through the interface 48. A control code decoding means 50 is connected to the control code receiving means 49. The control code decoding means 50 is adapted to connect its output to each of a motor drive control means 51, a needle stop position memory means 52, and a thread cut solenoid control means 53. The output of the control code decoding means 50 is also connected to each of a thread cut solenoid timing memory means 54, a wiper solenoid timing memory means 56, a presser bar raising solenoid control means 57, and a presser bar raising solenoid timing memory means 58. The output of the needle stop position memory means 52 is connected to the motor drive control means 51, the output of which is input to the presser bar raising solenoid control means 57. The output of the thread cut solenoid timing memory means 54 is connected to the thread cut solenoid control means 53, the output of which is connected to the wiper solenoid control means 55. The output of the wiper solenoid timing memory means 56 is connected to the wiper solenoid control means 55, the output of which is connected to the presser bar raising solenoid control means 57. The output of the presser bar raising solenoid timing memory means 58 is connected to the presser bar raising solenoid control means 57. The output of a stitch number count control means 59, to which the needle position sensing means 31 is connected, is connected to the motor drive control means 51. The output of the motor drive control means 51 is connected to the motor 30. The speed and the angle of the motor 30 are detected by the motor speed sensing means 46 and the motor angle sensing means 47, respectively. These outputs are connected to the motor drive control means 51. The output of the thread cut solenoid control means 53 is connected to the thread cut solenoid 43, and the output of the wiper solenoid control means 55 is connected to the wiper solenoid 44. The output of the presser bar raising solenoid control means 57 is connected to the presser bar raising solenoid 45. The output of the thread cut solenoid control means 53 is connected to the motor drive control means 51 and is further connected to a status read control means 60 for sensing a condition in which thread cutting is complete or motor drive is finished. The output of the motor drive control means 51 is connected to the status read control means 60. The output of the status read control means 60 is connected to a status encoding means 61, the output of which is connected to a status code transmitting means 62, the output of which his connected to the outside command system controller.

Figure 4:
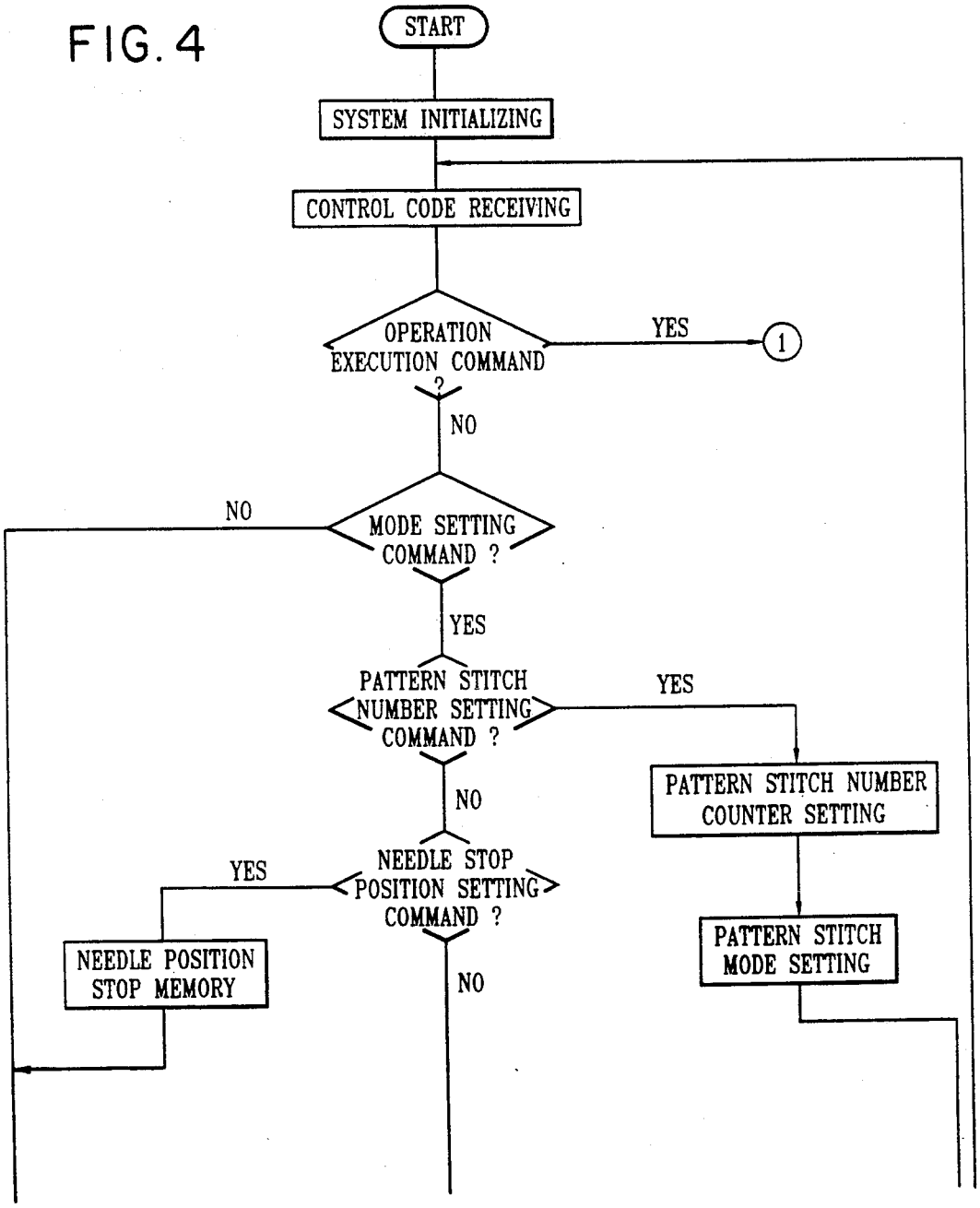
FIGS. 4 and 5 are flow charts each showing the operation of the drive system in FIG. 2.

The operation of the drive system of the invention will be explained with reference to a flow chart of the drive system shown in FIGS. 4 and 5.

When the drive system is started, the sewing machine is brought into a drive condition by the initial actuation of the system which checks whether or not the control code is received from the command system. In this instance, if the control code is input to the CPU 39 of the drive system controller 29 from the command controllers 34, 36 or the personal computer 38 and the like via the interface 48, the control code is received by the control code receiving means 49. The control code is then decoded by the control code decoding means 50 for deciding or judging whether the control code is an operation execution command or a mode setting command. If it is the operation execution command, the system follows the flow chart of FIG. 5.

If the control code is in the mode setting command, the CPU 39 successively judges what mode is required by the mode setting command according to the flow chart. In the case of a pattern stitch number setting command, the number of stitches is set to a stitch number count control means 59, and a pattern stitch mode is set. In the case of a needle stop position setting command, a needle setting stop position is stored in a needle stop position memory means (EEPROM) 52. This mode is in turn set to the presser bar raising solenoid control means. In the case of a thread cut solenoid timing setting command, the thread cut solenoid timing memory means 54 stores its timing therein. In the case of a wiper solenoid timing setting command, the wiper solenoid timing memory means 56 stores its timing therein. In the case of a presser bar raising solenoid timing setting command, a presser bar raising solenoid timing memory means 58 stores its timing therein.

Figure 5:
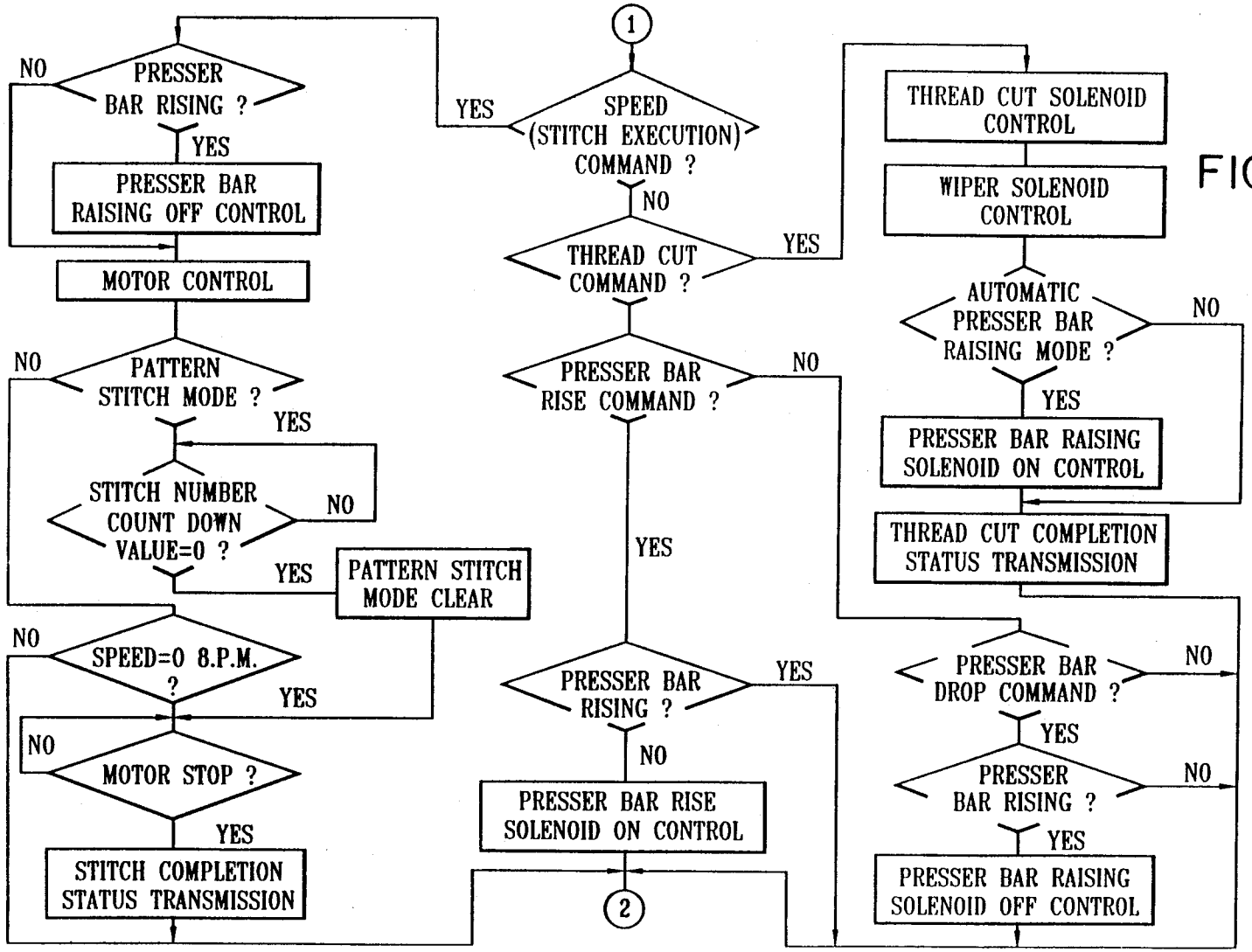

On the other hand, if the control code is the operation execution command, each operation is performed as shown in FIG. 5. If the CPU judges that a speed (sewing execution) command is entered and the presser bar is raised, the presser bar raising solenoid is driven so that the presser bar is lowered. Then, the rotation speed of the motor 30 is controlled by the output of the motor drive control means 51. If a pattern stitch mode is entered, the output of the needle position sensing means 31 is input to the stitch number count control means 59 to count the stitch number down. When the count value is zero, the pattern stitch mode is cleared away and the motor 30 stops. In a case where the motor 30 stops, a status code is transmitted to the outside command system via a status read control means 60, a status coding means 61, and a status code transmitting means. If a stop command (speed=0 s.p.m.) is entered, the speed of the motor 30 stops and permits transmission of stitch completion status code.

If the CPU 39 judges that a presser bar rise command is entered, the presser bar solenoid is energized, except for the case where the presser bar is raised. In contrast, if a presser bar lowering command is entered the presser bar raising solenoid 45 is deenergized except for the case where the presser bar is lowered.

After the aforementioned operations are performed, the invention checks for an error in each operation. Then the control code is received for next sewing operation (FIG. 4). As aforementioned, the control device for a sewing machine according to the embodiment of the invention is provided with a drive controller for driving the sewing machine body to perform the respective operations according to the control code input, while checking for error in the operations and transmitting the status code. The stitch completion status code is transmitted upon completion of the stitch operations. Accordingly, as shown in FIG. 1, the command controllers 34, 36, and the personal computer 38 can be used as the command system to input a predetermined control code, and the control device will be compatible to various sewing systems.

Figure 6:
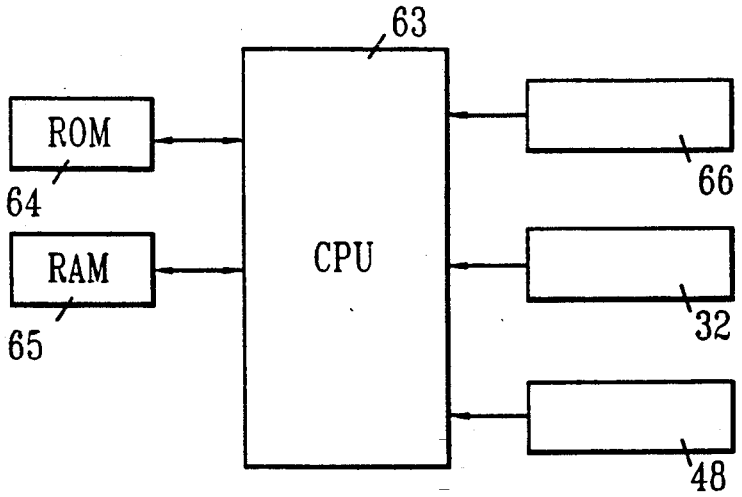
FIG. 6 is a block diagram of a command system according to the embodiment of the invention.
Figure 7:
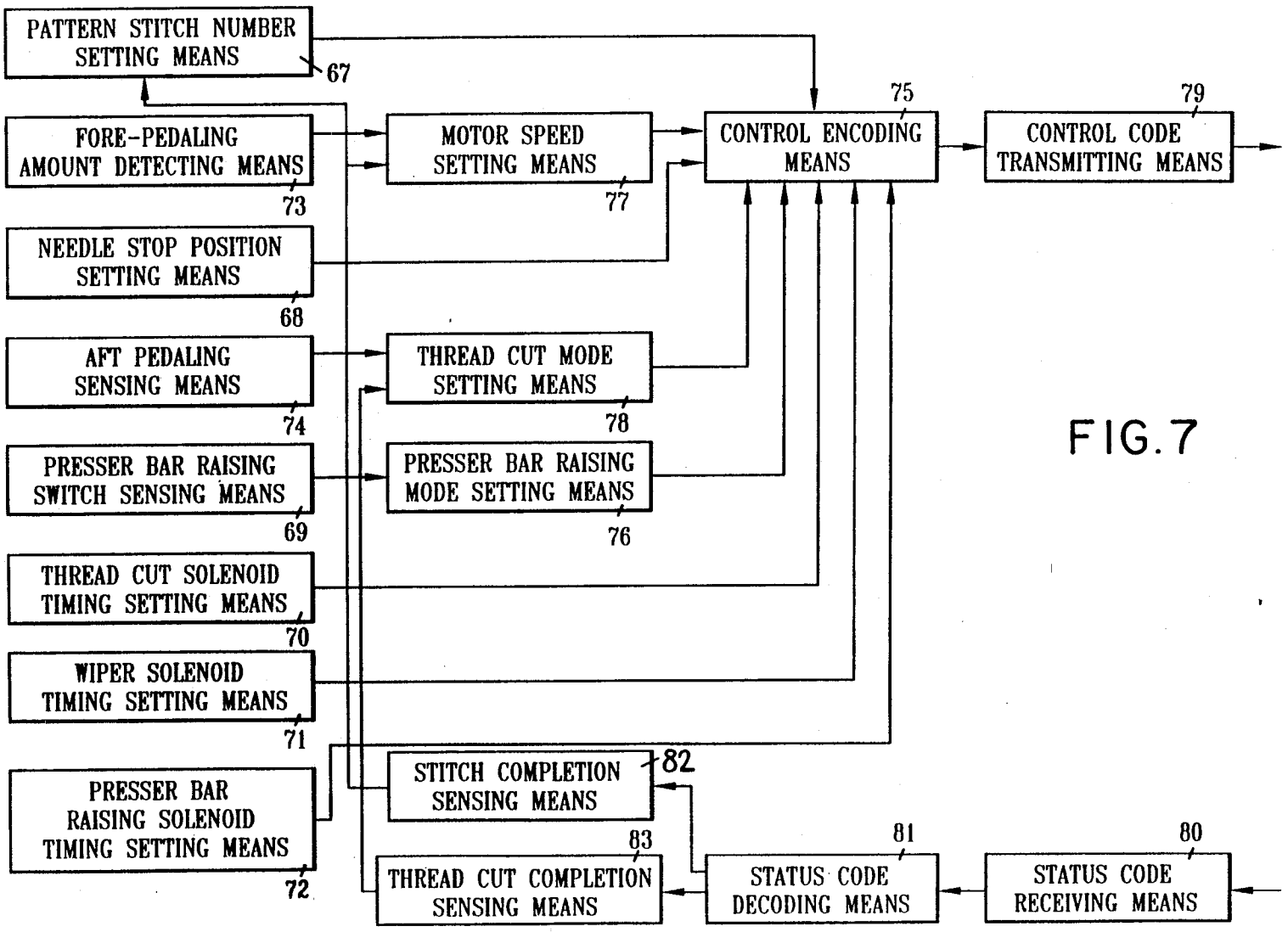
FIG. 7 is a block diagram showing functions of the command system in FIG. 6.

With reference to FIGS. 6 and 7, the command system controller 34, which inputs the control code to the control device, will be detailed. As shown in FIG. 6, the CPU 63 in the command system controller 34 (not shown) is connected to the ROM 64, the RAM 65, the pedal sensor 66, the control panel 32 and interface 48. The interface 48 is connected to the drive controller 29.

The details of the command system controller 34 will be apparent from the following description in conjunction with FIG. 7. The control panel 32 comprises a pattern stitch number setting means 67, a needle stop position setting means 68, a presser bar raising switch sensing means 69, a thread cut solenoid timing setting means 70, a wiper solenoid timing setting means 71, and a presser bar raising solenoid timing setting means 72. The pedal sensor 66 consists of a fore-pedalling amount detecting means 73 and an aft-pedalling amount sensing means 74. The outputs of the pattern stitch number setting means 67, the needle stop position setting means 68, the thread cut solenoid timing setting means 70, the wiper solenoid timing setting means 71, and the presser bar raising solenoid timing setting means 72 are connected to a control encoding means 75 to which the presser bar raising switch sensing means 69 is connected via the presser bar raising mode setting means 76. A fore-pedalling amount detecting means 73 is connected, via a motor speed setting means 77, to the control coding means 75. The aft-pedalling sensing means 74 is connected to the thread cut mode setting means 78. The control coding means 75 is connected to a control means which is connected to a control code transmitting means 79. The status code is received by a status code receiving means 80, the output of which is connected to a status code decoding means 81, the output of which is connected to a stitch completion sensing means 82 and a thread cut completion sensing means 83. The output of the stitch completion sensing means 82 is connected to the pattern stitch number setting means 67 and the motor speed setting means 77. The output of the thread cut completion sensing means 83 is connected to the thread cut mode setting means 78.

Figure 8:
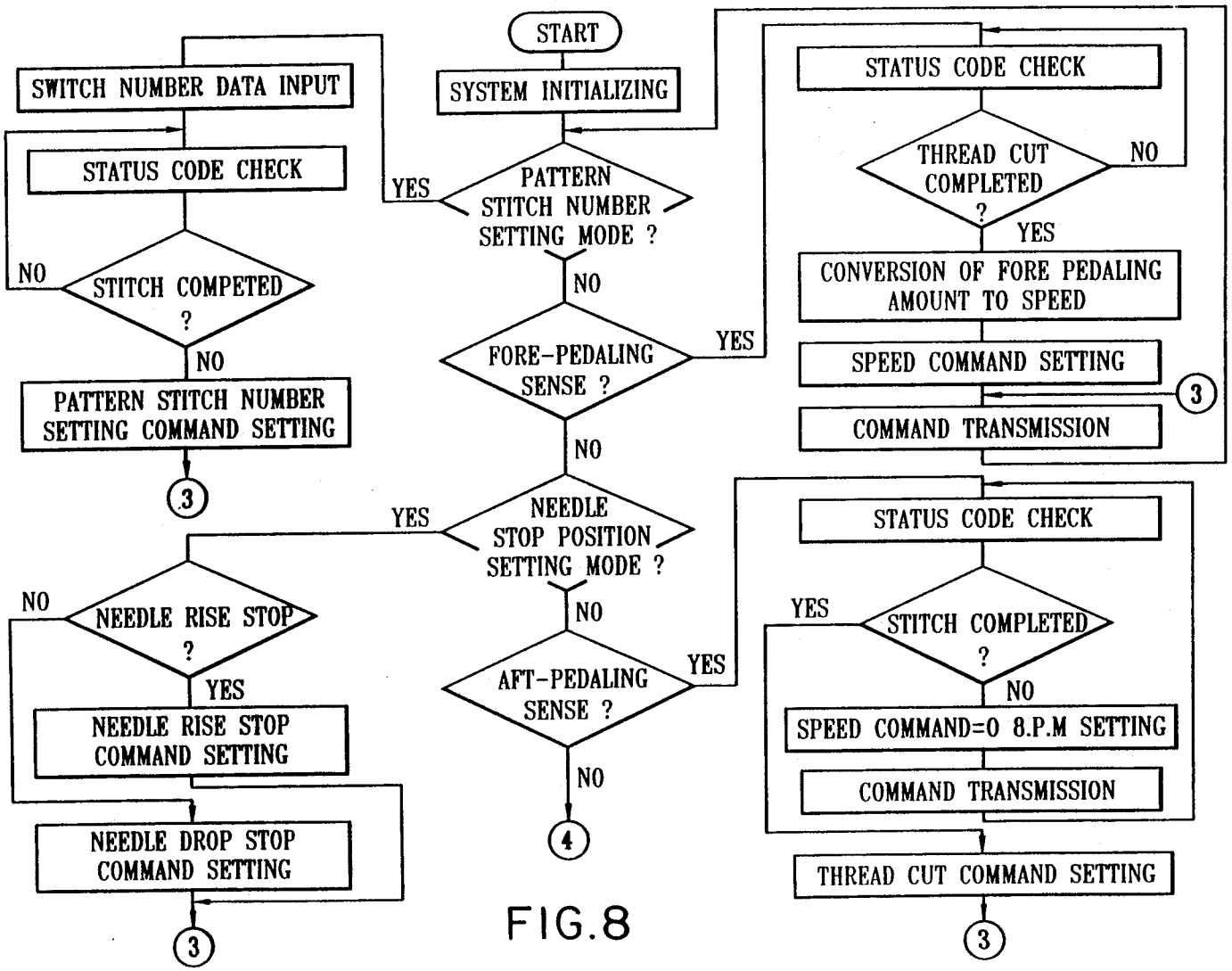
FIGS. 8 and 9 are flow charts which explain the operation of the command system shown in FIG. 7.
Figure 9:
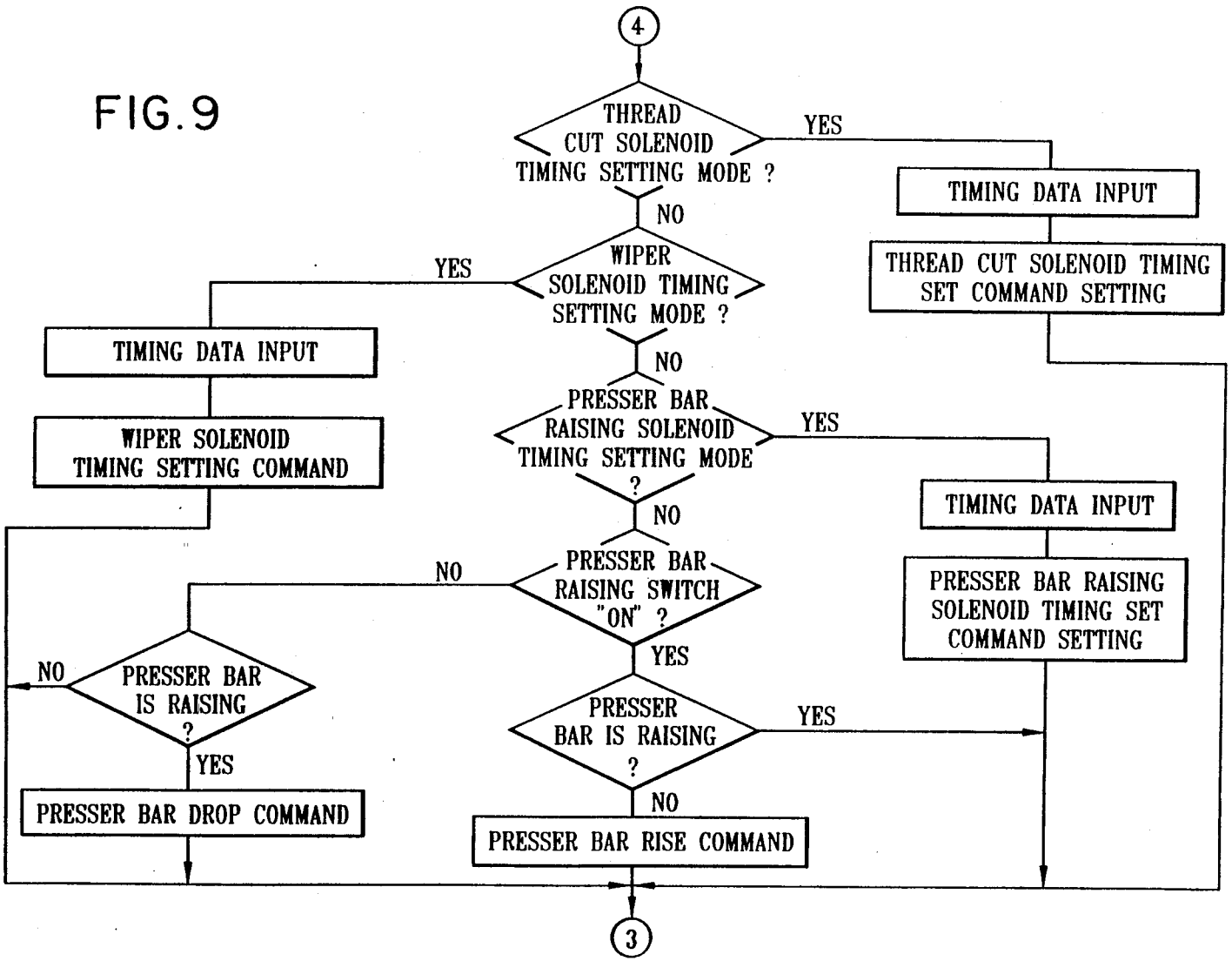

The operation of the command system controller 34 according to the embodiment of the invention will be explained with reference to the flow charts of FIGS. 8 and 9. In FIG. 8, the device is started and the system is initialized to check if the various settings are made by the control panel 32, the pedal 33 and the like. When a pattern stitch number setting mode is set by the pattern stitch number setting means 67 of the control panel 32, the status code from the drive system controller 29 is checked by the stitch completion sensing means 82 to check if the stitch is completed. Upon completion of the stitch, the pattern stitch number setting command is set by the control code generating means 79 according to the number of stitches as input. The pattern stitch number setting command is then transmitted from the control code transmitting means 79 to the drive system controller. The example of the control code is show in the following Table.

TABLE

| COMMAND | FUNCTION | CODE (HEX) |
|---|---|---|
| MODE SETTING | PATTERN STITCH NUMBER | 20H + n |
| | NEEDLE STOP POSITION | 21H + n |
| | AUTOMATIC PRESSER BAR RAISING | 22H + n |
| | THREAD CUT SOLENOID TIMING | 23H + n |
| | WIPER SOLENOID TIMING | 24H + n |
| | SOLENOID TIMING | 25H + n |
| | . | . |
| | . | . |
| | . | . |
| OPERATING EXECUTION | SPEED (STITCH EXECUTION) | 01h + n |
| | THREAD CUT | 02H |
| | PRESSER BAR RAISING | 03H |
| | PRESSER BAR LOWERING | 04H |
| | . | . |
| | . | . |
| | . | . |
| STATUS CODE | STITCH COMPLETION | 10H |
| | THREAD CUT COMPLETION | 11H |
| | . | . |
| | . | . |
| | . | . |

According to the Table, 20H in the column of the pattern stitch number setting command represents an identification code and n is indicative of the stitch number. The pattern stitching is started with fore-pedalling of the pedal 38.

If a fore-pedalling amount is detected by the fore-pedalling amount detecting means in a mode other than the pattern stitch number setting mode, thread cut completion is checked by the thread cut completion sensing means 83 from the drive system control 29. If thread cut is complete, the speed of the motor rotation is set at a speed command, according to the fore pedalling amount, and transmitted to the drive system. According to the Table, 01H in the column of speed (stitch execution) represents the identification code and n is indicative of the speed (s.p.m.).

If the needle position setting mode is set by the control panel 32 to index an upper stop the control encoding means 75 is set to a needle upper stop command. In contrast, if the needle position setting mode is set to index a lower stop, the needle lower stop command is set to be transmitted by the control code generating means 79. According to the Table, 21H in the column of the needle stop position is representative of the identification code. When the value of n is 0, the needle upper stop is represented. If it is 1, the needle lower stop is represented.

If the aft-pedalling is sensed by the aft-pedalling means 75 in a mode other than the pattern stitch number setting mode, the stitch completion sensing means 82 checks the status code from the drive system controller 29. If the stitch is not completed, the sewing machine speed is set to indicate 0 s.p.m.(stop). After the stitch is completed, the thread cut command is set by the thread cut solenoid timing setting means 70 and is then transmitted.

If the thread cut solenoid timing mode, wiper solenoid timing mode and the presser bar raising solenoid timing mode are set by thread cut solenoid timing setting means 70, wiper solenoid timing setting means 71, and the presser bar raising solenoid timing setting means 72, respectively, the respective timing setting commands are set as input, and are transmitted to the controller 29.

Figure 10:
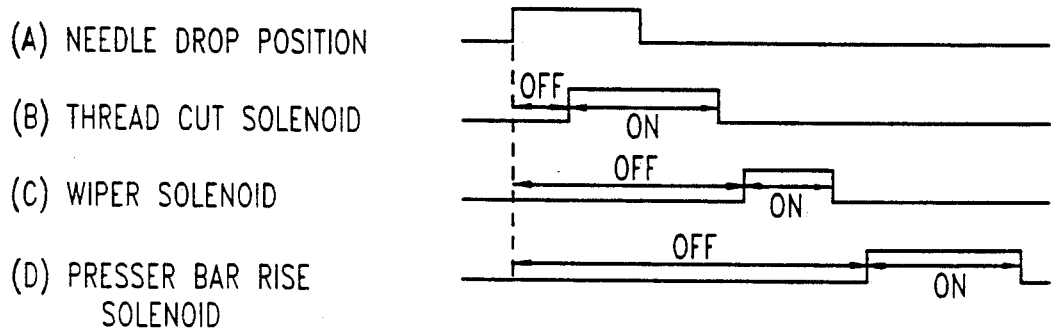
FIG. 10 is a time chart showing needle location and commands for setting timings of solenoids.
Figure 11:
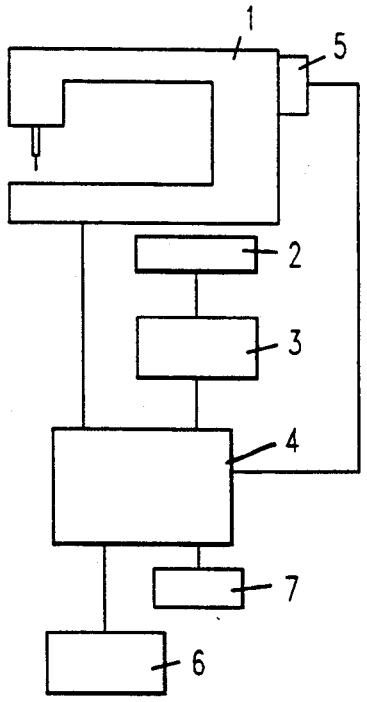
(PRIOR ART) FIG. 11
FIG. 11 is a block diagram of a conventional sewing machine control device.
Figure 12:
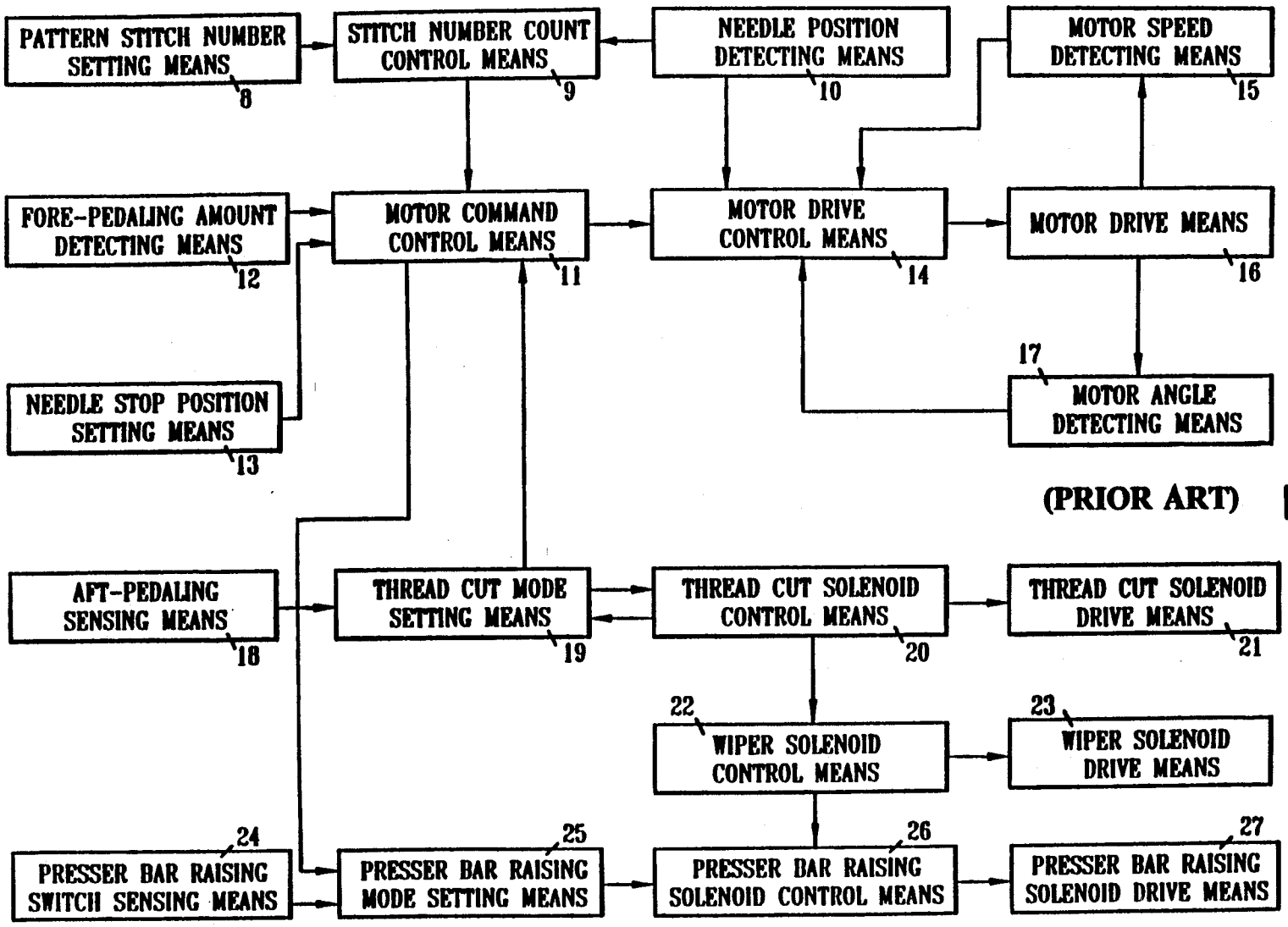
FIG.12 (PRIOR ART)
FIG. 12 is a block diagram illustrating functions of the sewing machine control device shown in FIG. 11.

One example of the sequence of setting these commands is shown in (A)–(D) of FIG. 10. As shown, (A) based on a pulse which senses the needle lower position; (B) the thread cut solenoid timing setting command is indexed by the thread cut solenoid 43 for an on time and an off time; whereas (C) the wiper solenoid timing setting command is indexed by the wiper solenoid 44 for an on time and an off time, and (D) the presser bar raising solenoid timing setting command is indexed by the presser bar raising solenoid 45 for an on time and an off time. When a presser bar up and down switch (not shown) is depressed, the presser bar raising switch sensing means 69 is checked to determine whether the switch is on or off. If the switch is on, the presser bar raising command is set by the presser bar raising mode setting means 76 except if the presser bar is in the raised condition. In contrast, if the switch is off, the presser bar lowering command is set by the presser bar raising mode setting means 76 except if the bar is in the lowered condition. These commands are encoded by the control encoding means 75 and transmitted by the control code transmitting means 79. The aforementioned check is repeatedly made to make a lock stitch or a chain stitch.

The embodiment as set forth has been described as the command system controller 34 for the lock stitch or the chain stitch; the transmission system controller 36, for the automatic sewing machine; and, a personal computer 38 may be similarly connected to the device so that the control commands as shown in the Table may be readily input by the control panel 35 or the keyboard 37.

What is claimed is:

1. A sewing system including a driving system provided in a sewing machine, a control system being arranged apart from said sewing machine and an interface for connecting said driving system and said control system;

said driving system comprising a plurality of mechanisms including a thread cutting mechanism, a wiper mechanism and a presser-foot mechanism, a motor of variable speed for driving said sewing machine, a plurality of driving means for driving respectively each of said mechanisms, and a speed control means for controlling the speed of said motor;

said control system coding a mode setting command and an operation execution command as a control code and generating said control code, said mode setting command for setting a driving condition for each of said driving means and said speed control means, said operation execution command for sequentially conducting predetermined sewing operations; and said driving system further having decoding means for decoding said control code and a memory for registering the decoded mode setting command, whereby said driving system drives said driving means and said speed control means according to the decoded mode setting command recorded in said memory and the decoded operation execution command.

2. A sewing system as set forth in claim 1, wherein said driving system includes a status code generating means for sensing respective status of each of said mechanisms and said motor and generating a status code as a result of said sensing, and wherein said control system receives said status code and generates said operation execution command according to said status code.

3. A sewing machine as set forth in claim 1 wherein said command system comprises a command system controller and a control panel connected to said command system controller to output a control code to said drive system controller in response to the input from said control panel to control said drive system controller.

4. The sewing machine as set forth in claim 1 wherein said command system controller is responsive to a pedal.

5. A sewing machine as set forth in claim 1 wherein said command system includes a personal computer and a keyboard connected thereto to output said control code to said drive system controller.

* * * * *